United States Patent [19]

Poran et al.

[11] Patent Number: 4,516,624

[45] Date of Patent: May 14, 1985

[54] MOLD ASSEMBLY FOR CONTINUOUS CASTING

[75] Inventors: Michael Poran, Westwood, N.J.; Carl Langner, Monsey; Chester C. Tobiasz, Elmhurst, both of N.Y.

[73] Assignee: Concast Incorporated, Montvale, N.J.

[21] Appl. No.: 334,342

[22] Filed: Dec. 24, 1981

[51] Int. Cl.[3] ..... B22D 11/00; B22D 11/04

[52] U.S. Cl. ..... 164/418; 164/436

[58] Field of Search ..... 164/436, 491, 418

[56] References Cited

U.S. PATENT DOCUMENTS

| | | | |
|---|---|---|---|
| 3,292,216 | 12/1966 | Colombo | 164/436 X |
| 3,295,172 | 1/1967 | Dain | 164/418 |
| 3,528,483 | 9/1970 | Mallener | 164/436 X |
| 3,528,485 | 9/1970 | Vogel | 164/418 |
| 3,550,672 | 12/1970 | Fastert et al. | 164/418 |
| 3,559,720 | 2/1971 | Vogel et al. | 164/418 |
| 3,710,845 | 1/1973 | Burkhardt et al. | 164/436 |
| 3,735,801 | 5/1973 | Burkhardt | 164/436 |
| 3,913,658 | 10/1975 | Schmid | 164/436 X |
| 3,964,727 | 6/1976 | Gladwin | 164/436 X |
| 4,069,863 | 1/1978 | Hargassner et al. | 164/436 |
| 4,085,793 | 4/1978 | Scheinecker et al. | 164/436 |
| 4,124,059 | 11/1978 | Roggo | 164/436 |
| 4,129,174 | 12/1978 | Holleis et al. | 164/418 X |
| 4,147,202 | 4/1979 | Gay | 164/436 |
| 4,356,860 | 11/1982 | Gladwin | 164/436 X |

FOREIGN PATENT DOCUMENTS

| | | | |
|---|---|---|---|
| 11537 | 5/1980 | European Pat. Off. | 164/418 |
| 2478502 | 9/1981 | France | 164/436 |
| 47-23764 | 7/1972 | Japan . | |
| 47-32178 | 8/1972 | Japan | 164/418 |
| 51-32429 | 3/1976 | Japan | 164/418 |
| 52-25372 | 7/1977 | Japan | 164/436 |
| 346911 | 12/1974 | U.S.S.R. . | |
| 597495 | 2/1978 | U.S.S.R. | 164/418 |

*Primary Examiner*—Nicholas P. Godici
*Assistant Examiner*—J. Reed Batten, Jr.

[57] ABSTRACT

A continuous casting mold assembly has a pair of end plates which are releasably clamped between a pair of side plates and cooperate with the same to define an open-ended mold cavity. A single tie-rod at either end of the pair of side plates spans the side plates and provides a clamping function and an alignment function. Clamping is accomplished by clamping nuts on the tie-rods and the torque required to turn the nuts is maintained at a low value by means of thrust bearings. Alignment is achieved via tongues on the tie-rods which contact the side plate to be located at the neutral axis of the continuous casting apparatus. The tongues cooperate with locator heads on the respective tie-rods to define a predetermined distance of such magnitude that the side plate contacted by the tongues lies at the neutral axis when the locator heads abut fixed reference elements on the mold table. The invention provides simplification and increased operational reliability.

13 Claims, 4 Drawing Figures

L
11
12
13
14
15
16
17
18
20
21
22
23
24
25
26
27
28
G
1a
1b
2a
2b
3a
3b
4
5
6
7
8a
8b
9
10
IV
II

MOLD ASSEMBLY FOR CONTINUOUS CASTING

FIELD OF THE INVENTION

The invention relates generally to the continuous casting of metals, e.g. steel.

More particularly, the invention relates to a mold assembly for continuous casting.

BACKGROUND OF THE INVENTION

Apparatus for the continuous casting of a large strand such as a bloom or a slab generally includes a mold assembly which is followed by a roller guide for the strand.

The mold assembly includes two pairs of plates which cooperate to define the mold cavity. One of the pairs of plates is clamped between the other.

Clamping is usually accomplished mechanically using tie-rods which are stressed by means of clamping nuts. In such an arrangement, the clamping nuts must be subjected to very high torques in order to achieve clamping forces of the required magnitudes. This makes the clamping operation a difficult one. Furthermore, at least two, and frequently more, tie-rods are provided at either end of the mold assembly. This results in a relatively complex design both as regards machining of the mold assembly and obtaining the correct stresses in the various tie-rods.

In addition to proper clamping, a prerequisite for successful continuous casting is precise alignment of the mold cavity relative to the roller guide. One known alignment technique involves placing the mold assembly on the mold table or support and then shifting the mold assembly until the mold cavity is correctly aligned with the roller guide. Since the alignment process, which is time-consuming, is carried out in the casting machine, this technique greatly reduces the availability of the machine for casting.

An arrangement which enables the availability of the casting machine to be increased consists of two or more locator pins on the mold table and flanges on the mold assembly having holes which receive the locator pins. This arrangement, however, poses a problem when the plates defining the mold cavity are machined to remove wear marks and other surface defects generated during use. Thus, the positions of the plate surfaces relative to the holes in the flanges are changed when material is removed during machining so that the mold cavity is no longer in alignment with the roller guide when the mold assembly is placed on the mold table.

The preceding problem is overcome by a technique for aligning the mold cavity off the casting machine in a mold preparation area. The mold assembly is here again provided with flanges having holes which receive locator pins on the mold table. However, the positions of the holes in the flanges are adjustable. A template is placed in the mold cavity such that a face of the template intimately contacts one of the surfaces bounding the mold cavity. The surface contacted by the template is that which is to be aligned with the lower track or run of the roller guide when the mold assembly is on the mold table. The template has a leg which passes over the upper edge of the mold assembly and is provided with openings corresponding to the holes in the flanges of the mold assembly. The openings are at a fixed distance from the face of the template in contact with the mold surface to be aligned with the lower track of the roller guide. This distance, in turn, is equal to the desired distance between the locator pins on the mold table and the position to be occupied by the mold surface which is to be in alignment with the lower roller guide track. The holes in the flanges are aligned with the openings in the template and, after removal of the template from the mold assembly, the latter is set on the mold table so that the holes in the flanges receive the locator pins. The mold cavity is now properly aligned without the need for performing any adjustments in the casting machine.

Although the last-described technique avoids the problems outlined above, it increases the complexity of the mold assembly. Furthermore, the template required for this technique constitutes an additional item to be stored and maintained in an area which is already crowded.

OBJECTS OF THE INVENTION

It is an object of the invention to simplify the alignment of a mold assembly.

Another object of the invention is to simplify the alignment of a mold assembly of the type having plates which are clamped together to define a mold cavity.

SUMMARY OF THE INVENTION

The preceding objects and others will become apparent as the description proceeds.

In accordance with the invention, a mold assembly for a continuous casting apparatus has a plurality of plates which cooperate to define a mold cavity. One feature of the mold assembly according to the invention resides in a device for both clamping the plates in position relative to one another and aligning the mold cavity in position for casting.

The clamping and alignment of the invention permits a mold assembly to be aligned off the casting apparatus without the use of a separate template. This eliminates the need for storing such templates in the relatively crowded mold preparation area and also simplifies the mold assembly in that it is not necessary to equip the same with flanges having adjustable holes. Moreover, since the device in accordance with the invention performs both the clamping and alignment functions, clamping and alignment may be carried out in one operation thereby decreasing operating costs.

In a preferred embodiment of the invention, a single clamping and alignment device is provided in the region of each of two opposite ends of the mold assembly so that the mold assembly has a total of two such devices. This advantageous construction compares very favorably with the known mechanically clamped mold assemblies where four or more tie-rods are present.

Other features and advantages of the invention will become apparent from the following description when read in conjunction with the appended drawing.

DESCRIPTION OF THE PREFERRED EMBODIMENTS

Figure 1:
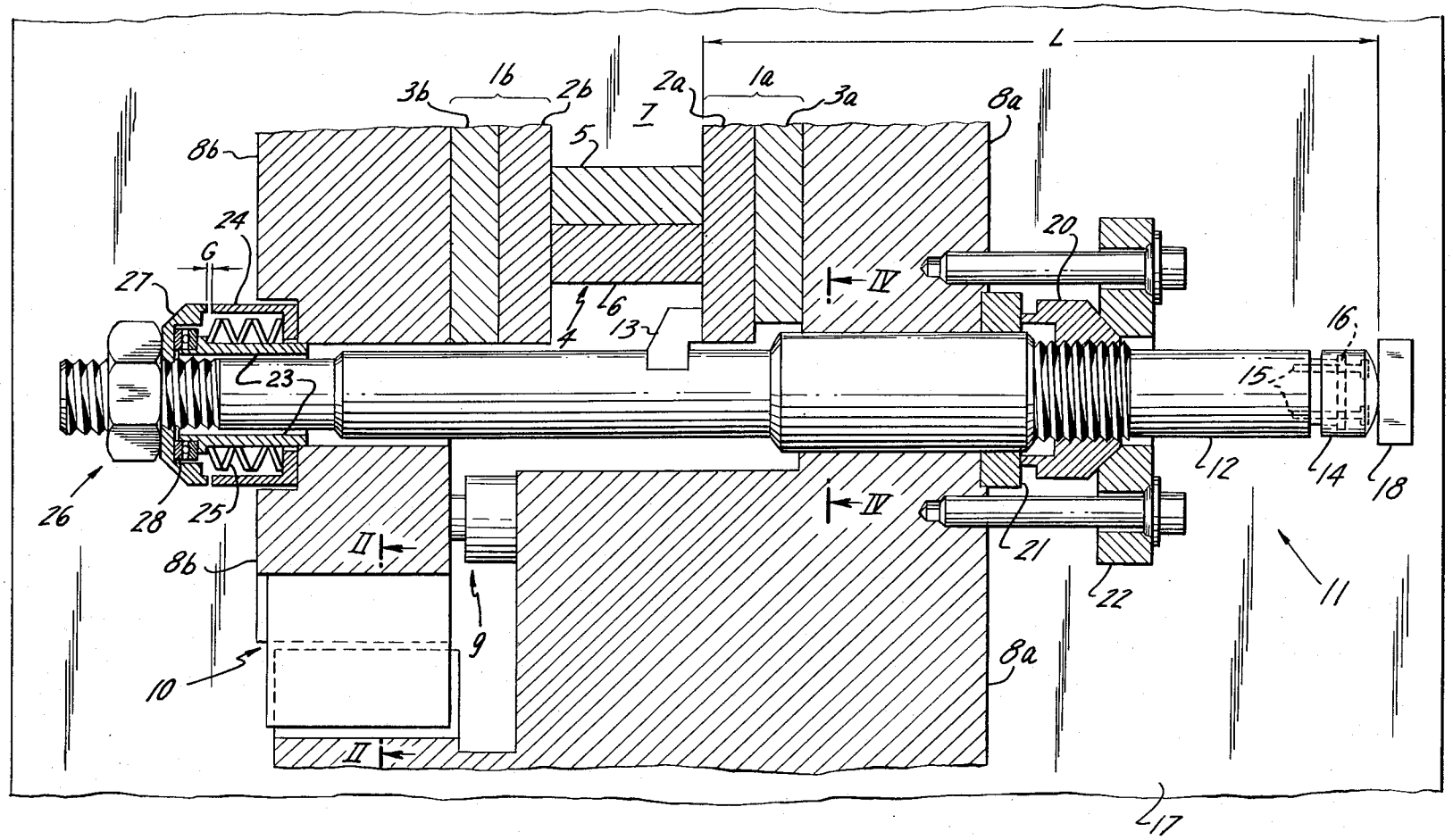
FIG. 1 is a horizontal cross-sectional view of a mold assembly according to the invention.

FIG. 1 illustrates a mold assembly for use in an apparatus for the continuous casting of metals, e.g. steel. Only those details of the mold assembly necessary for an understanding of the invention are shown.

The mold assembly is of the type generally used for the casting of large strands such as blooms and slabs. In the present embodiment, the mold assembly includes a pair of conventional wide plates 1*a* and 1*b* having respective thermally conductive portions 2*a* and 2*b* typically composed of a copper alloy and respective back-up portions 3*a* and 3*b* typically composed of steel. The thermally conductive portions 2*a* and 2*b* cooperate with the associated back-up portions 3*a* and 3*b* to define non-illustrated cooling passages for the respective wide plates 1*a* and 1*b*. Only one of the two longitudinal ends of the wide plate pair, and hence of the mold assembly, is shown since the structure of the other end is identical.

A conventional narrow plate 4 is releasably clamped between the wide plates 1*a* and 1*b* at either end of the wide plate pair. Since only one of the longitudinal ends of the wide plate pair is illustrated, only one of the narrow plates 4 is seen. The narrow plates 4 each comprise a thermally conductive portion 5 typically composed of a copper alloy and a back-up portion 6 typically composed of steel. The thermally conductive portion 5 and back-up portion 6 of each narrow plate 4 cooperate to define non-illustrated cooling passages for the respective narrow plate 4.

The wide plates 1*a* and 1*b* cooperate with the narrow plates 4 to define a mold cavity 7 which determines the dimensions of the strand. The narrow plates 4 are connected with non-illustrated spindles which permit the narrow plates 4 to be moved towards and away from one another once the narrow plates 4 have been unclamped to thereby change the dimensions of the mold cavity 7.

The wide plates 1*a* and 1*b* are connected to respective mold frames 8*a* and 8*b*. The mold frame 8*a* is fixedly mounted in the continuous casting apparatus while the mold frame 8*b* is movable towards and away from the fixed mold frame 8*a*. Piston-and-cylinder units 9 are interposed between the fixed and movable mold frames 8*a* and 8*b* and function to move the mold frame 8*b* towards and away from the mold frame 8*a*. Movement of the mold frame 8*b* away from the mold frame 8*a* frees the narrow plates 4 for displacement while the reverse movement of the mold frame 8*b* causes the narrow plates 4 to contact and be clamped by the wide plates 1*a* and 1*b*. The mold frames 8*a* and 8*b* have cooperating guide means 10 which fix the mold frames 8*a* and 8*b* in the correct position relative to one another and guide the mold frame 8*b* during displacement thereof. The guide means 10 also compensates for rotational misalignments of the mold frames 8*a* and 8*b*.

Figure 2:
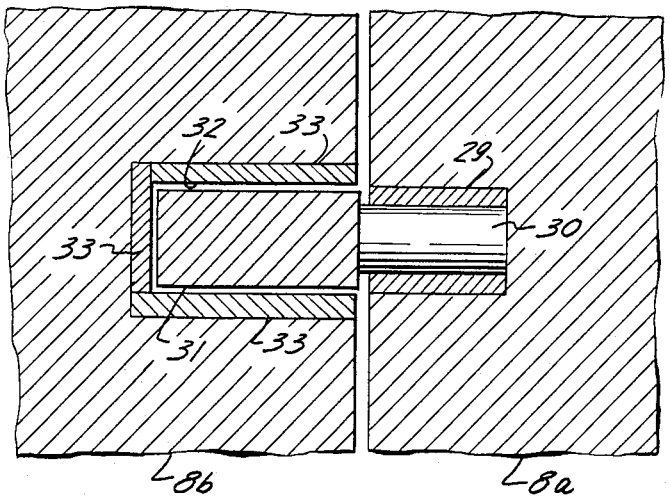
FIG. 2 is a cross-sectional view in the direction of the arrows II—II of FIG. 1 showing cooperating guide means for the mold assembly.
Figure 3:
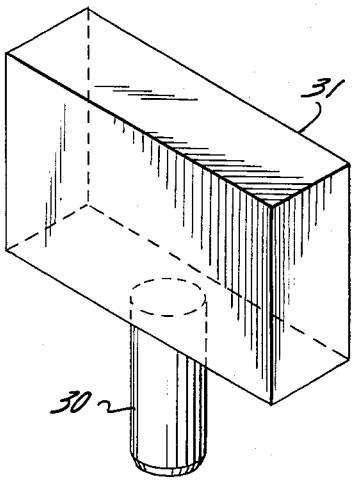
FIG. 3 is a perspective view of a guide element for use in the guide means of FIG. 2.

The cooperating guide means 10 is illustrated in greater detail in FIGS. 2 and 3.

With reference to FIGS. 2 and 3, a bushing 29 is inserted in the mold frame 8*a*. A shaft 30 connected with a guide block 31 is rotatably mounted in the bushing 29. The guide block 31 is received in a recess 32 which is formed in the mold frame 8*b* and is lined with wear plates 33. The guide block 31 fixes the mold frames 8*a* and 8*b* in the correct position relative to one another and guides the mold frame 8*b* during displacement thereof. Since the guide block 31 is connected to the rotatable shaft 30, the guide block 31 can rotate to accommodate rotational misalignments of the mold frames 8*a* and 8*b*. The ability of the mold assembly to compensate for rotational misalignments of the mold frames 8*a* and 8*b* assures that the narrow plates 4 are always in firm engagement with the wide plates 1*a* and 1*b*.

The mold assembly is held together by devices 11 located at either longitudinal end of the mold assembly. According to the invention, the devices 11, of which only one is shown, serve both to clamp the narrow plates 4 between the wide plates 1*a* and 1*b* and to align the mold assembly in position for casting. In the present embodiment, only one of the devices 11 is provided at either longitudinal end of the mold assembly, that is, the mold assembly is held together by two of the devices 11.

Each of the devices 11 includes a tie-rod 12 which extends through passages in and spans the mold frames 8*a* and 8*b*. The tie-rods 12 are provided with tongues 13 having faces which bear against that surface of the wide plate 1*a* facing the mold cavity 7. The tie-rods 12 further have heads 14 which are releasably secured to the tie-rods 12 via screws 15 and can be adjusted by means of one or more shims 16 so that a desired constant distance "L" is obtained between the tips of the heads 14 and the faces of the tongues 13 bearing against the wide plate 1*a*. When the mold assembly is placed on a mold table 17 of the continuous casting apparatus, the heads 14 of the tie-rods 12 are contacted with fixed abutments 18 on the mold table 17. This assures that the surface of the wide plate 1*a* engaged by the tongues 13 is always at the same distance "L" from the abutments 18 and that the mold assembly and mold cavity 7 are thus always properly aligned in the continuous casting apparatus. The distance "L" is selected such that the surface of the wide plate 1*a* contacted by the tongues 13 coincides with the neutral axis of the continuous casting apparatus.

Figure 4:
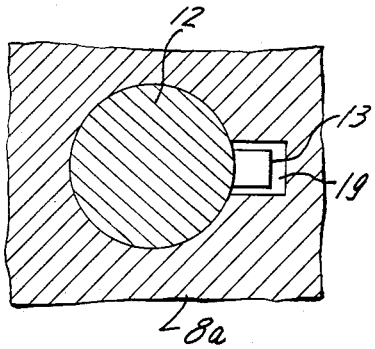
FIG. 4 is a cross-sectional view in the direction of the arrows IV—IV of FIG. 1 illustrating a detail of the mold assembly.

The mold frame 8*a* is formed with a pair of grooves 19 of which one is shown in FIG. 4 and with which the respective tongues 13 can be aligned upon rotation thereof from the position illustrated in FIG. 1. The grooves 19, which are parallel to the tie-rods 12, enable the latter to be inserted into and withdrawn from the mold assembly.

The tongues 13 are held in firm engagement with the wide plate 1*a* by nuts 20 which act on back-up rings 21 interposed between the mold frame 8*a* and the nuts 20. Shock-absorbing clamps 22 bear against the nuts 20 in order to absorb the shock of impacts applied to the tie-rods 12 and thereby prevent the tongues 13 from damaging the wide plate 1*a*.

Sleeves 23 are mounted on the tie-rods 12 at the ends thereof opposite the heads 14. The sleeves 23 are encircled by caps 24 which engage the mold frame 8*b*. The sleeves 23 and caps 24 define annular spaces which accommodate springs 25. The springs 25 bear against the sleeves 23 and caps 24 thus urging the wide plate 1*b* into engagement with the narrow plates 4.

Clamping nuts 26 formed with caps 27 and threaded onto the tie-rods 12 adjacent the sleeves 23. Thrust bearings 28 are accommodated inside the caps 27 and bear against the latter as well as the sleeves 23. The clamping force required to maintain the narrow plates 4 in position between the wide plates 1*a* and 1*b* is applied by the clamping nuts 26. This force is transmitted to the mold frame 8*b*, and hence the narrow plates 4, via the thrust bearings 28, sleeves 23, springs 25 and caps 24. The thrust bearings 28 reduce the torque which must be applied to the clamping nuts 26 in order to achieve the requisite clamping force.

A gap "G" exists between the caps 24 and 27 and permits the piston-and-cylinder units 9 to move the mold frame 8*b* away from the narrow plates 4 against the action of the springs 25 without loosening the clamping nuts 26. This makes it possible to easily and rapidly free the narrow plates 4 for displacement so as to change the dimensions of the mold cavity 7.

The illustrated mold assembly according to the invention is simpler than conventional mold assemblies since the clamping and alignment functions are combined in one device. Furthermore, only a single clamping and alignment device need be provided at either longitudinal end of the mold assembly so that only two tie-rods may be present as opposed to the four or more tie-rods found in the mechanically clamped mold assemblies of the prior art. In addition, the illustrated mold assembly may be aligned off the continuous casting apparatus without the use of special templates. Also, the torque required to generate the requisite clamping force is 40 to 45 percent less than in conventional, mechanically clamped mold assemblies due to the presence of thrust bearings on the clamping and alignment devices of the illustrated mold assembly.

It will be understood that various modifications may be made within the scope of the invention.

We claim:

1. A mold assembly for a continuous casting apparatus having a guide for a continuously cast strand which issues from said mold assembly, a mold support table for supporting said mold assembly, and the mold support table being provided with a fixed element said mold assembly comprising:

(a) a plurality of plates which cooperate to define a mold cavity; and (b) a device for both clamping said plates in position relative to one another and aligning said mold cavity with reference to the strand guide, and said device comprising a rod arranged to exert clamping pressure on said plates, and clamping means for applying said clamping pressure, said rod having a tongue which contacts one of said plates, and said rod having a reference end which abuts the fixed element to the mold support table when said assembly is in position for casting and defines a predetermined distance with said tongue to thereby align said mold cavity with reference to the strand guide.

2. An assembly as defined in claim 1, said assembly having two ends and said device being located in the region of one of said ends; and wherein an additional device for both clamping said plates in position relative to one another and aligning said mold cavity with reference to the strand guide is located in the region of the other of said ends.

3. An assembly as defined in claim 2, wherein said devices alone clamp said plates in position relative to one another.

4. An assembly as defined in claim 1, wherein said tongue contacts said one plate on a side of the latter facing said mold cavity.

5. An assembly as defined in claim 4, wherein said side of said one plate is arranged to be aligned with the neutral axis of the continuous casting apparatus when said assembly is in position for casting.

6. An assembly as defined in claim 1, wherein said clamping means comprises a rotatable clamping member on said rod and said device includes torque-reducing means operative to reduce the torque applied to said rotatable clamping member during clamping of said plates.

7. An assembly as defined in claim 6, wherein said torque-reducing means comprises a thrust bearing on said rod.

8. An assembly as defined in claim 1, comprising mold frames for carrying at least some of said plates; and wherein said rod is arranged to exert said clamping pressure on said mold frames and one of said mold frames has a groove which is aligned with said torque upon rotation of the latter to a predetermined position to thereby permit withdrawal of said rod from said assembly.

9. An assembly as defined in claim 1, wherein said clamping means comprises a clamping element on said rod to hold said tongue in engagement with said one plate.

10. An assembly as defined in claim 10, comprising a shock-absorbing element on said rod which bears against said clamping element to prevent said tongue from damaging said one plate.

11. An assembly as defined in claim 1, comprising a resilient element on said rod to urge said plates into contact with one another.

12. An assembly as defined in claim 1, comprising a pair of relatively movable supports each carrying one of said plates; and wherein one of said supports has a recess and the other of said supports carries a guide which is received in said recess and cooperates with the same to guide said supports during movement of the latter relative to one another, said guide being rotatably mounted in said another support to permit rotational adjustment of said supports relative to one another.

13. A mold assembly for a continuous casting apparatus having a guide for a continuously cast strand which issues from said mold assembly, the continuous casting apparatus further having a mold support table for supporting said mold assembly, and the mold support table being provided with a fixed element, said assembly comprising:

(a) a plurality of plates which cooperate to define a mold cavity;

(b) a device for both clamping said plates in position relative to one another and aligning said mold cavity with reference to the strand guide, said device including a rod arranged to exert clamping pressure on said plates, and clamping means for applying said clamping pressure, said rod having a tongue which contacts one of said plates, and said rod having a reference end which abuts the fixed element of the mold support table when said assembly is in position for casting and defines a predetermined distance with said tongue to thereby align said mold cavity with reference to the strand guide, said clamping means comprising a rotatable clamping member on said rod, and said device including torque-reducing means operative to reduce the torque applied to said rotatable clamping member during clamping of said plates; and (c) mold frames for carrying at least some of said plates, said rod being arranged to exert said clamping pressure on said mold frames, and one of said mold frames having a groove which is aligned with said tongue upon rotation of the latter to a predetermined position to thereby permite withdrawal of said rod from said assembly.

* * * * *